US010616673B2

(12) United States Patent
Mobed et al.

(10) Patent No.: US 10,616,673 B2
(45) Date of Patent: Apr. 7, 2020

(54) SNAPFOLD HEADBAND CUSHION

(71) Applicant: BOSE CORPORATION, Framingham, MA (US)

(72) Inventors: Darius Mobed, Watertown, MA (US); Joel H. Miller, Westborough, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/982,019

(22) Filed: May 17, 2018

(65) Prior Publication Data

US 2019/0356976 A1 Nov. 21, 2019

(51) Int. Cl.
*H04R 5/033* (2006.01)
*H04R 1/10* (2006.01)

(52) U.S. Cl.
CPC ..... *H04R 1/1008* (2013.01); *H04R 1/1066* (2013.01); *H04R 1/1083* (2013.01); *H04R 5/0335* (2013.01)

(58) Field of Classification Search
None
See application file for complete search history.

(56) References Cited

U.S. PATENT DOCUMENTS

| | | | | |
|---|---|---|---|---|
| 7,377,666 | B1 | 5/2008 | Tyler | |
| 2010/0046782 | A1* | 2/2010 | Ito | H04R 5/0335 381/378 |
| 2014/0205130 | A1* | 7/2014 | Blair | H04R 5/0335 381/378 |
| 2016/0050486 | A1* | 2/2016 | Uggla | H04R 1/1091 381/378 |
| 2017/0318371 | A1* | 11/2017 | McAllister | H04R 1/1058 |
| 2018/0302708 | A1* | 10/2018 | Monaghan | H04R 5/0335 |

* cited by examiner

*Primary Examiner* — Quoc D Tran
(74) *Attorney, Agent, or Firm* — Patterson + Sheridan, LLP

(57) ABSTRACT

A headband cushion cover for installation on a headphone assembly is provided. The headband cushion cover includes an elongated foam member, an elongated rear flap, an inner edge of the rear flap foldably attached along a first edge of the elongated foam member; and an elongated front flap, an inner edge of the front flap foldably attached along a second edge of the elongated foam member, wherein each of the front and rear flaps snaps between two opposite arched positions when folded along the respective inner edges of the front and rear flaps, and wherein the headband cushion cover is designed to cover an arched portion of the headband.

15 Claims, 13 Drawing Sheets

SNAPFOLD HEADBAND CUSHION

TECHNICAL FIELD

Aspects of the present disclosure generally relate to a headphone assembly that can be assembled by an end consumer, and more specifically to a headband and headband cushion cover of the headphone assembly.

BACKGROUND

Human beings, especially children have a natural curiosity that lends itself to science, technology, and engineering. Certain educational products (e.g., educational toys) are designed to inspire children and adults to build on their innate desire for answers by exploring engineering concepts in a fun, hands-on way. For instance, building based toys or construction toys are examples of educational toys that have been shown to have significant cognitive and academic benefits for people of all ages. Not only are they fun and exciting, but they help children and adults develop a wide variety of skills and abilities. Further, assembling a product from its component parts encourages thinking and reasoning and helps learning about the inner workings of the parts and the product as a whole. Additionally, incorporating some form of gamification in an educational product makes learning of scientific and technological concepts a fun experience.

Audio headphones/headsets are immensely popular and extensively used by adults and children of all ages. While audio headphones are available in numerous designs and configurations, they are traditionally not known to have much educational value. Headphone technology has considerably matured over the years and most headphones available today have highly refined constructions and include complex electronic components. Audio headphones can benefit from attaching educational value that encourages learning about the overall design of the headphones and the technology involved.

SUMMARY

All examples and features motioned herein can be combined in any technically possible manner.

Aspects of the present disclosure provide a headphone assembly capable of assembly by an end customer. The headphone assembly generally includes a left ear cup and a right ear cup, the left and right ear cups pre-connected with an electrical wire; an elongated headband pre-formed into an arched shape, each of the left and right ear cups loaded on to a different end of the headband using a yoke member, each yoke member connecting one of the ear cups to the headband; and a headband cushion cover that covers an arched portion of the headband. The headband cushion cover generally includes an elongated foam member; an elongated rear flap, an inner edge of the rear flap foldably attached along a first edge of the elongated foam member; and an elongated front flap, an inner edge of the front flap foldably attached along a second edge of the elongated foam member, wherein each of the front and rear flaps snaps between two opposite arched positions when folded along the respective inner edges of the flaps.

Aspects of the present disclosure provide a headband cushion cover for installation on a headband of a headphone assembly. The headband cushion generally includes an elongated foam member; an elongated rear flap, an inner edge of the rear flap foldably attached along a first edge of the elongated foam member; and an elongated front flap, an inner edge of the front flap foldably attached along a second edge of the elongated foam member; wherein each of the front and rear flaps snaps between two opposite arched positions when folded along the respective inner edges of the front and rear flaps, and wherein the headband cushion cover is designed to cover an arched portion of the headband.

Aspects of the present disclosure provide a headband cushion cover for installation on a headband of a headphone assembly. The headband cushion generally includes an elongated foam member; an elongated rear flap, an inner edge of the rear flap foldably attached along a first edge of the elongated foam member; an elongated front flap, an inner edge of the front flap foldably attached along a second edge of the foam member, wherein each of the front and rear flaps snap between two opposite arched positions when folded along the respective inner edges of the front and rear flaps; and a hook and loop fastener to secure the ends of the headband cushion cover to the headband after the headband cushion cover is installed onto the headband, wherein the headband cushion cover covers an arched portion of the headband.

In an aspect, each of the front and rear flaps is pre-formed into an arched shape that substantially matches the arched shape of the headband. In an aspect, each of the front and rear flaps includes an insert disposed along an inner surface of the flap. The insert is pre-formed into an arched shape that substantially matches the arched shape of the headband, such that each flap snaps between the two opposite arched positions when folded along the inner edge of the flap. Each of the front and rear flaps along with the insert is made of a flexible material allowing the flap to fold over the elongated foam member. The insert itself is made of an elastic material that allows the insert to be deformed to a flat state or a near flat state and restore to one of the two arched positions. For example, the insert is made of thermoformed plastic.

In an aspect, the headband cushion cover includes a hook and loop fastener to secure the ends of the front and rear flaps to the headband after the headband cushion cover is installed on the headband. In an aspect, an outer surface of the elongated foam member is covered with a soft material. In an aspect, the headband cushion cover conceals the electrical wire connecting the left and right ear cups.

In an aspect, a width of the elongated rear flap is shorter than a width of the elongated front flap, such that when the rear flap is folded onto the elongated foam member and the front flap is folded onto the folder rear flap, an outer edge of the front flap aligns with the inner edge of the rear flap.

In an aspect, the elongated foam member is pre-formed into an arched shape that substantially matches the arched shape of the headband.

Other features and advantages will be apparent from the description and the claims.

DETAILED DESCRIPTION

Figure 1:
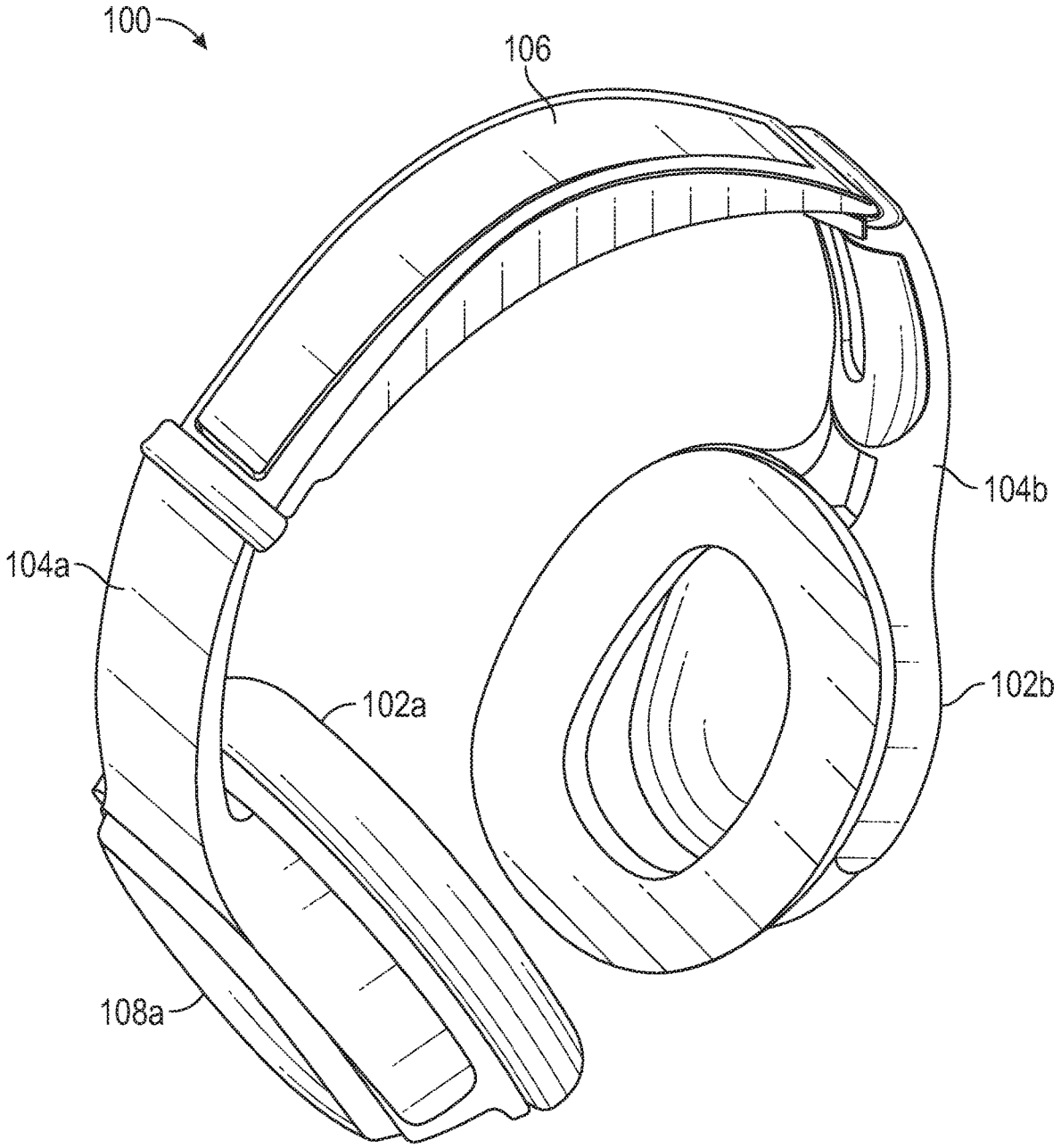
FIG. 1 illustrates an example headphone assembly 100, in accordance with aspects of the present disclosure.

Aspects of the present disclosure describe an audio headphone assembly, which in some examples may include several component parts that are meant to be assembled by an end consumer, such that the act of assembly provides educational value and gamification before the product is presented in its final form factor. For example, building/assembling the headphone assembly from its component parts gives an end consumer appreciation of the component parts used to build the headphone assembly, the function of the component parts, the overall construction of the headphone assembly, and how the component parts work together to function as one headphone unit.

Several challenges exist in designing a headphone assembly that is meant to be assembled by an end consumer. For example, the headphone assembly should be designed in a way that is easy to assemble (e.g., especially by children) by following simple instructions. Additionally, an assembled headphone should have a cosmetically clean and aesthetically pleasing look, should be comfortable to wear, and should effectively perform its intended function.

For example, in the context of pre-assembled headphones (e.g., assembled during manufacturing), wires including the electrical wire running between the two headphone cups are hidden in the mechanics of the headband that connects the ear cups over the head and/or a headband cushion that sits over the head and provides for a comfortable wear. However, the headband along with the headband cushion of a headphone assembly that a consumer receives in component parts for assembly, should be designed in a way that is easy to assemble/install and still effectively hides the wire(s) for a clean and aesthetically pleasing finish. Additionally, the headband and headband cushion should be comfortable to wear for fairly long periods. When the headband and the headband cushion is designed for assembly by children, the instructions for the assembly and the actual assembly itself should be straightforward enough so that children are able to perform the assembly without much trouble and/or help from adults.

Certain aspects of the present disclosure generally discuss a design for a headphone assembly, which in some examples, is designed to be assembled by an end consumer. The headphone assembly is sold to the end consumer as several component parts and is provided with a set of instructions for the end consumer to follow to assemble the parts into one functioning headphone unit. Portions of the disclosure specifically focus on the design of a headband and a headband cushion cover of the headphone assembly which allows simple assembly by children of most ages as well as adults by following instructions, while at the same time providing a clean, aesthetically pleasing, high-quality headphone assembly that is comfortable to wear for fairly long time periods; however, the headband cushion design described herein is applicable outside of the user-assembled context. In an aspect, the design of the headband cushion cover may be used with headphones and/or headsets that are not designed to be assembled by an end consumer. For example, the headband cushion cover described in this disclosure may be used as a user replaceable part for headphones and/or headsets.

FIG. 1 illustrates an example headphone assembly 100, in accordance with aspects of the present disclosure. The headphone assembly 100 includes two ear cup assemblies 102*a*, 102*b* connected by an elongated headband. Each of the two ear cup assemblies 102*a*, 102*b* are loaded on to a different end of the headband using a yoke member 104*a*, 104*b*, respectively. In an aspect, the elongated headband is pre-formed in an arch shape to comfortably fit around a top of a user's head. A headband cushion cover 106 covers the arched portion of the headband. Specific features of the headband cushion cover 106 are described herein.

The headphone assembly 100 may include a wireless communication unit coupled to a processor and a memory configured to store instructions executable by the processor. The wireless communication unit is configured to wirelessly receive audio signals and commands from a source device. The source device includes any device capable of generating and transmitting audio signals or wireless commands to the headphone assembly. For example, the source device can be a mobile device such as a smartphone, a tablet computer, an e-reader, or a portable media player. The source device can also be a portable or non-portable media playing device such as a TV, a disk-player, a gaming device, an audio/video (AV) receiver, or a media streaming device. According to an example, the wireless communication unit of the headphone assembly establishes a wireless link with the source device in accordance with Bluetooth®, Bluetooth® Low Energy (BLE), Wi-Fi, or another personal area network (PAN) protocol.

In certain aspects, the headphone assembly includes components of an active noise reduction (ANR) system. The headphone assembly may also include other functionality such as a microphone so the headphone assembly can function as a headset.

In certain aspects, one or more ear cup customization features are used to illuminate an external surface of the ear cup assemblies 102*a*, 102*b*. 108*a* is an example of an external surface on the ear cup 102*a* that is customizable through color and/or insert selection. The ear cup 102*b* has a similar external surface that is not visible in FIG. 1. Specific ear cup customization features are described in Ser. No. 15/982063, titled "EAR CUP CUSTOMIZATION," also filed on May 17, 2018, which is expressly incorporated by reference in its entirety.

FIGS. 2A to 2F illustrate example component parts of the headphone assembly 100, in accordance with certain aspects of the present disclosure. As shown in FIGS. 2A to 2F, the headphone assembly includes two ear cups 202, two ear cushions 204, a headband 206, two yokes 208, a headband cushion cover 210, and two trim rings 212. It may be noted that the component parts shown in FIGS. 2A to 2F are not an exhaustive list of component parts and that the headphone assembly may include additional component parts. Further, the yokes 208 shown in FIG. 2D correspond to 104*a*, 104*b* and the headband cushion cover 210 shown in FIG. 2E corresponds to headband cushion cover 106 illustrated in FIG. 1.

Figure 2A:
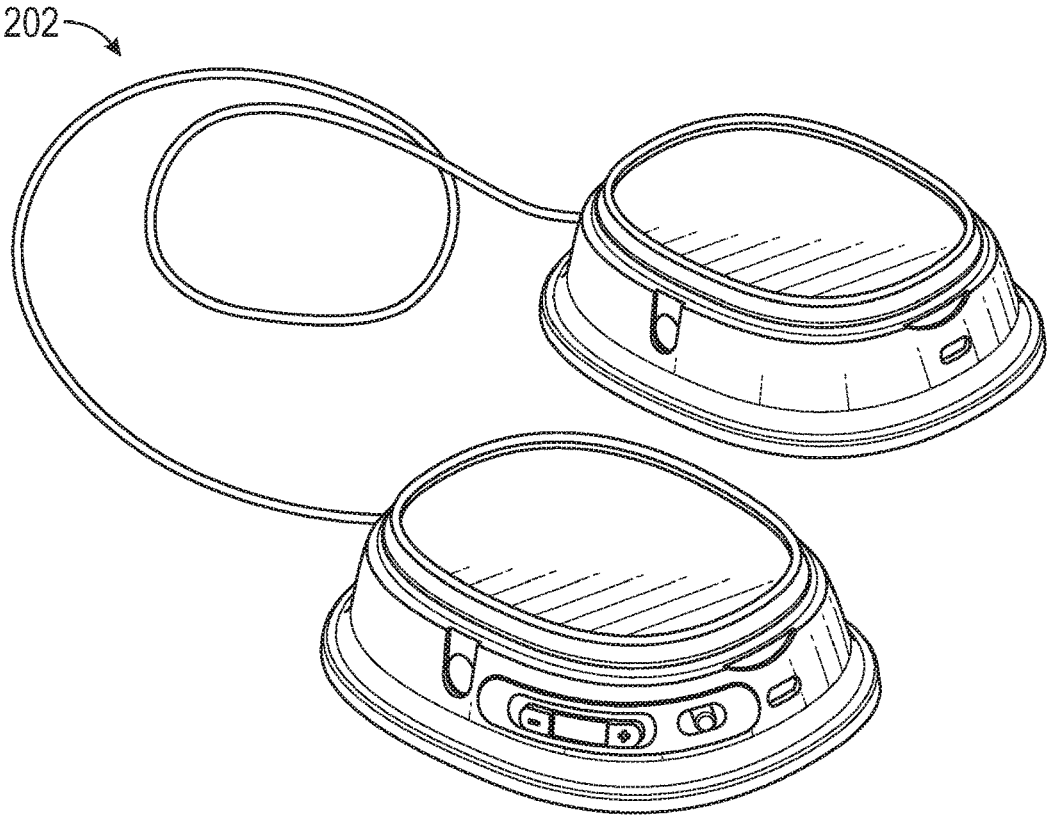
FIGS. 2A to 2F illustrate example component parts of the headphone assembly 100, in accordance with certain aspects of the present disclosure.

The ear cups 202 shown in FIG. 2A are small loudspeaker drivers worn on or around a user's head. The ear cups 202 generally include electroacoustic transducers which convert electrical signals to corresponding sound. In an aspect, one or both of the ear cups 202 include a microphone so that the headphones can be used as a headset. In an aspect, the ear cups 202 include other electronic components to provide additional functionality including buttons, LED bulbs, processors, wireless transceivers, noise reduction electronics and the like. In an aspect, as shown in FIG. 2, the ear cups 202 are pre-connected by an electrical wire that helps the ear cups 202 exchange electrical signals. In an aspect, the ear cups 202 include a left ear cup designed for a user's left ear and a right ear cup designed for the user's right ear.

Figure 2B:
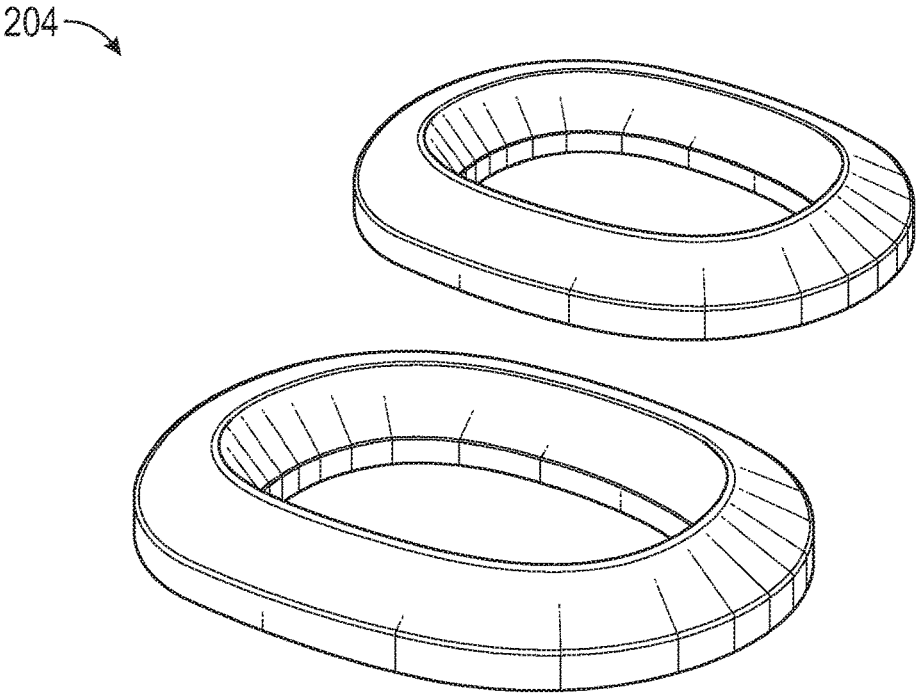

Each of the ear cushions 204 as shown in FIG. 2B is designed to cover at least a portion of an inner surface of an ear cup 202 (e.g., facing the user's ear) along its perimeter. The ear cushions contact the user's ear and are generally made of a soft material or a combination of soft materials to provide a comfortable wear. For example, the ear cushions 204 are made of a foam material covered with polyurethane leather.

Figure 2C:
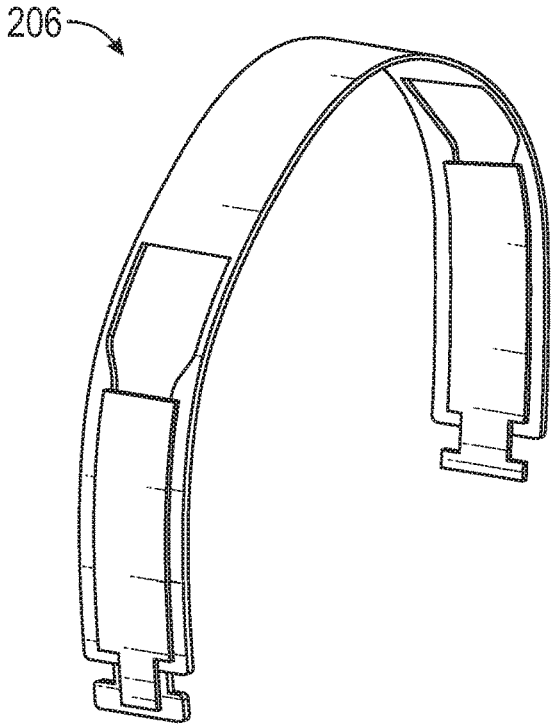

The headband 206 as shown in FIG. 2C is generally an elongated piece of a flexible plastic material or metal (e.g., metal spring) pre-formed into an arched shape. Each of the left and right ear cups 202 are loaded on to one of the ends of the headband 206 using a yoke member 208. The arched shape of the headband 206 generally conforms to the shape of a user's head and allows a user to wear the headphone assembly over the head or around the head. In an aspect, the headband 206 comes pre-loaded with wire guides at each end of the headband 206 that hold the electrical wire connecting the ear cups 202 in a region where the electrical wire has some slack to allow for adjusting a length of the headband between the ear cups 202 to suit a user's listening position.

Figure 2D:
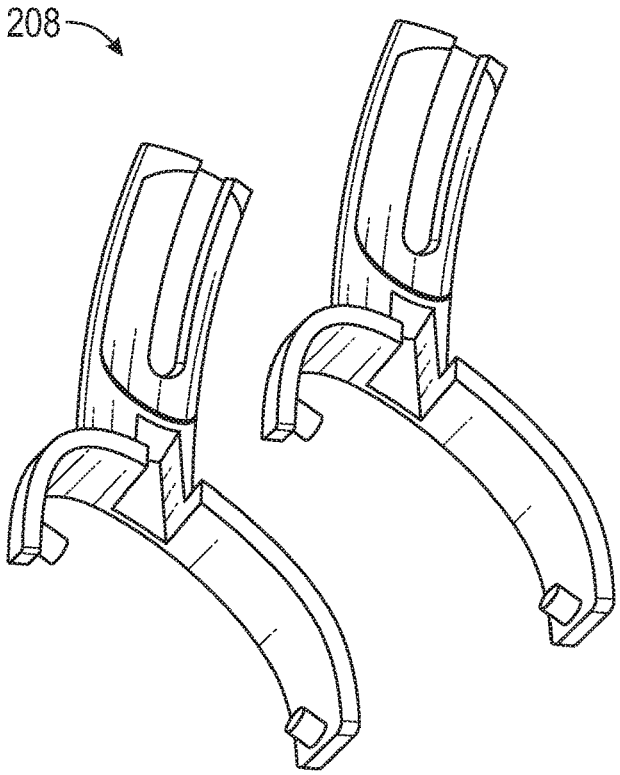

As noted above, each of the yoke members 208 as shown in FIG. 2D helps connect an ear cup 202 to an end of the headband 206. Each yoke member 208 includes means to hold an ear cup 202 at one end and connect to the headband 206 at another end. In an aspect, a mechanism is provided at the end of each yoke member 208 where the yoke member 208 connects to the headband 206, to allow the headband 206 to slide in and out of the yoke member 208 in order to adjust a distance between the ear cups 202.

Figure 2E:
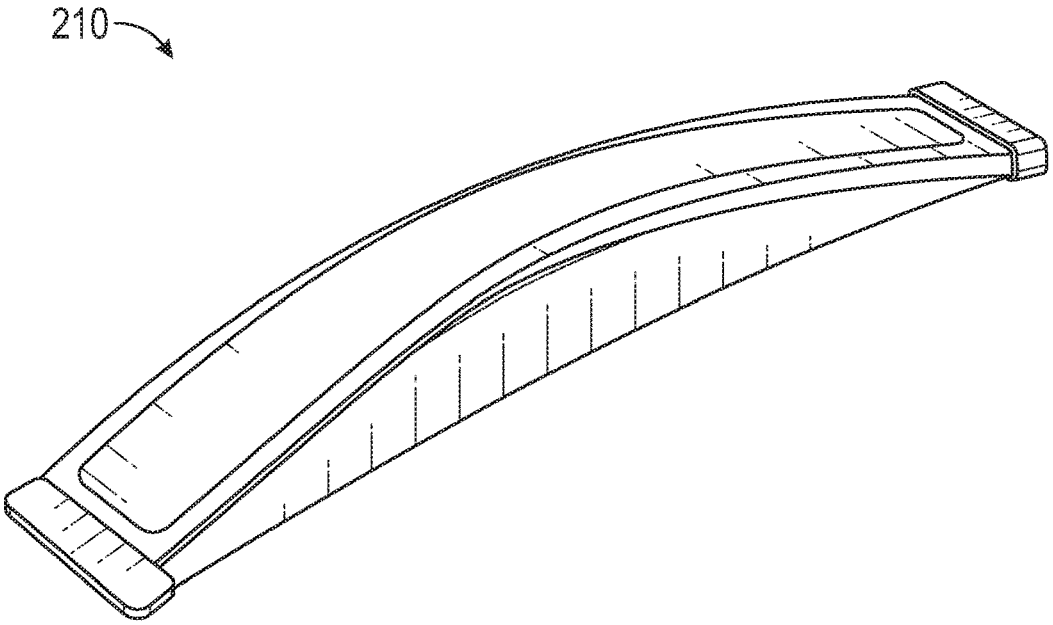

The headband cushion cover 210 as shown in FIG. 2E covers an arched portion of the headband 206 to provide an aesthetically pleasing look to the headphone assembly and to provide a comfortable wear on the user's head. In an aspect, the headband cushion cover 210 conceals the electrical wire connecting the ear cups 202.

Figure 2F:
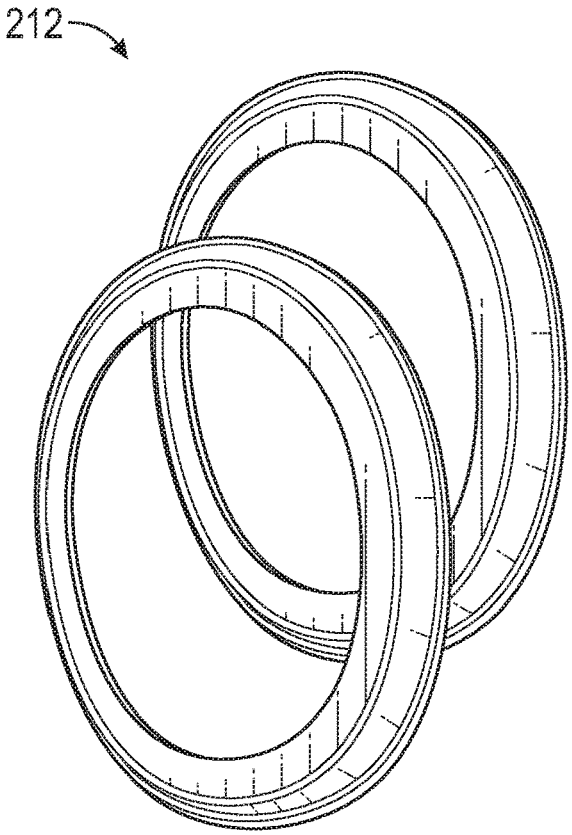

Each of the trim rings 212 as shown in FIG. 2F is removably positioned along an outer perimeter of an outer surface of an ear cup 202. Therefore, the trim ring 212, at least partially, overlays the ear cup 202. In an aspect, the trim ring 212 advantageously overlays the ear cup 202 with or without a customizable insert placed between the outer surface of the ear cup 202 and the trim ring 212.

As noted above, the component parts shown in FIGS. 2A to 2F are designed to be assembled by an end consumer by following a provided set of instructions.

Figure 3A:
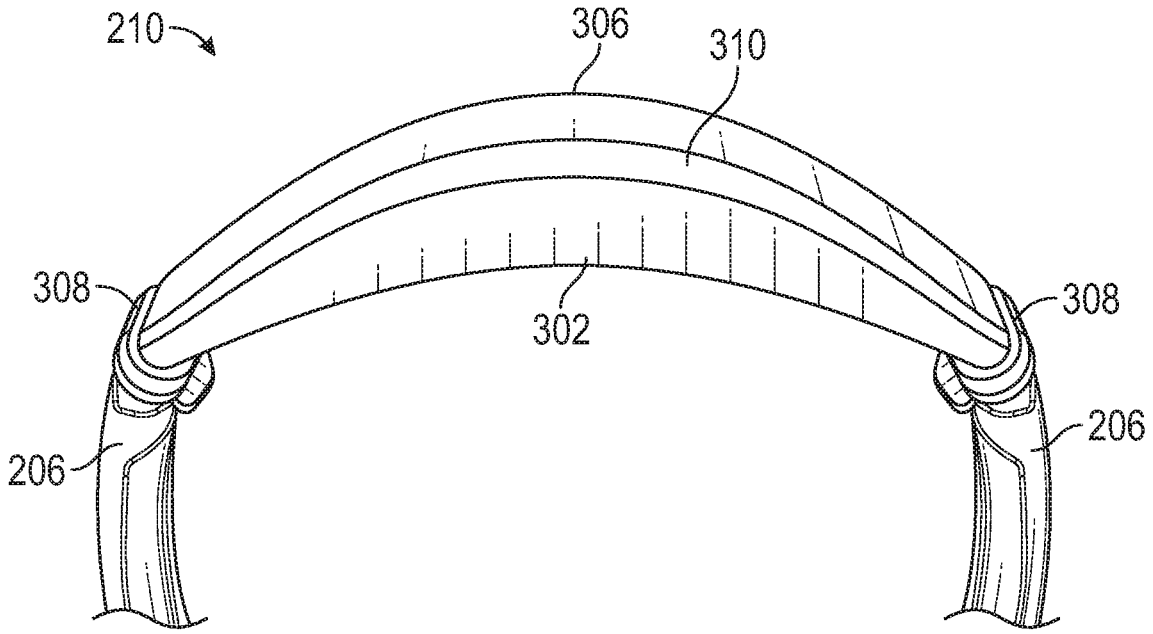
FIGS. 3A to 3E illustrate an example design of a headband cushion cover 210 in accordance with certain aspects of the present disclosure.
Figure 3B:
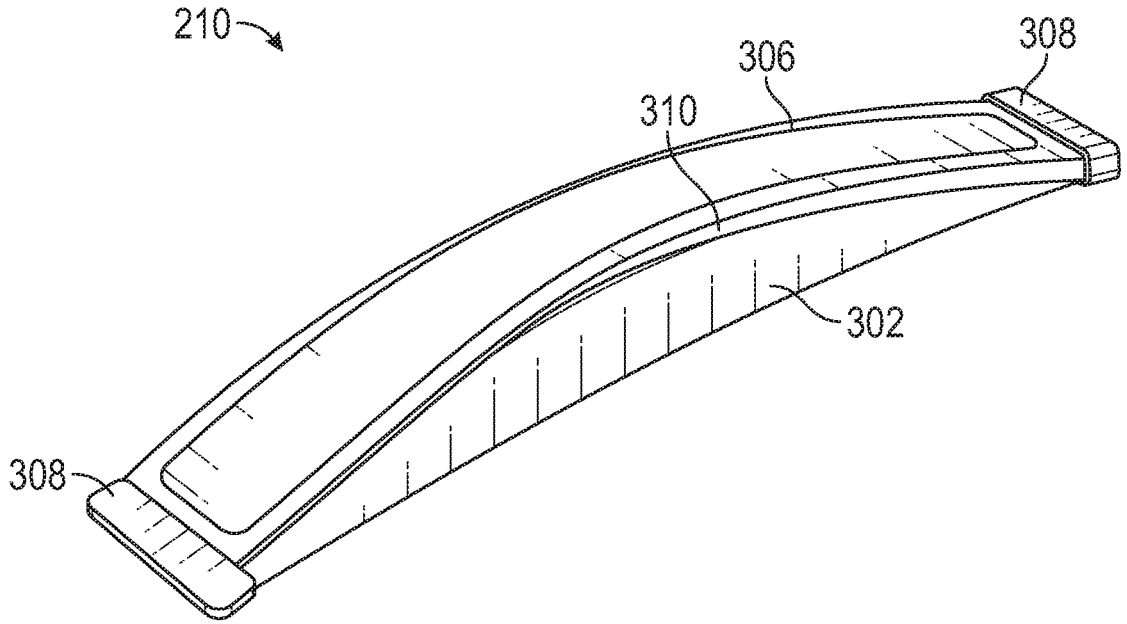
Figure 3C:
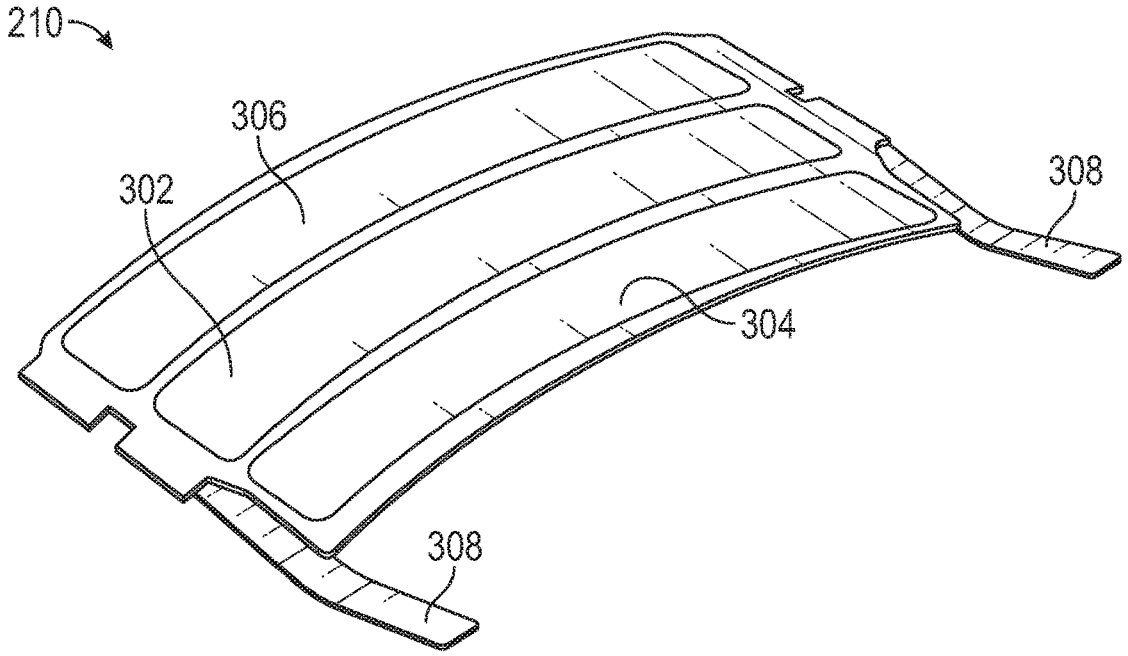
Figure 3D:
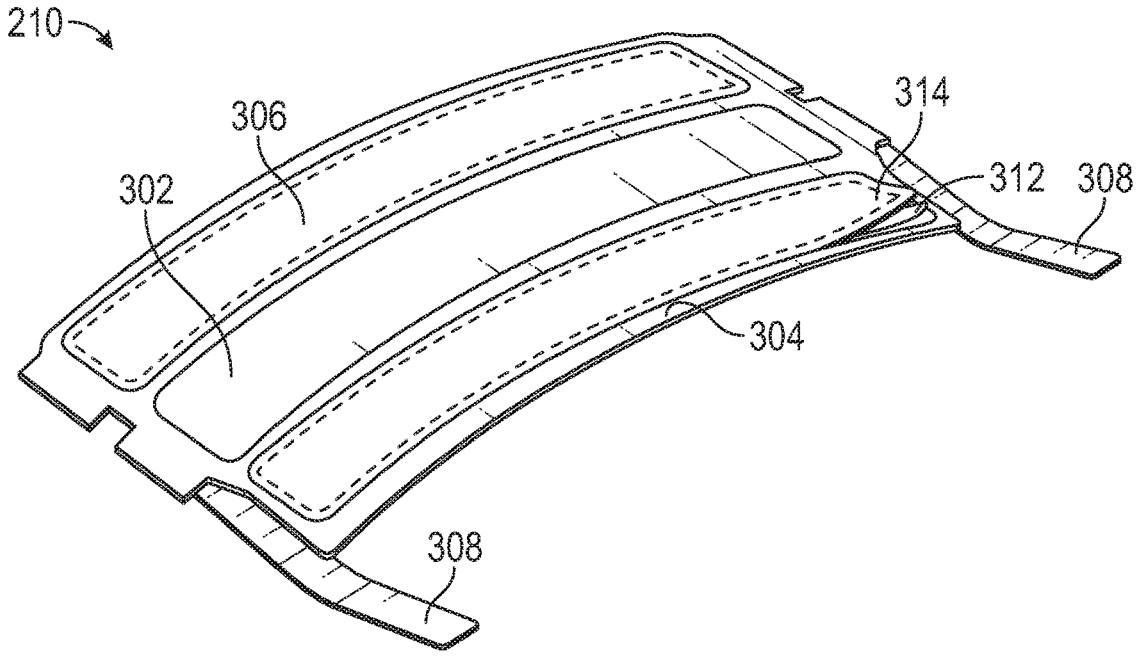
Figure 3E:
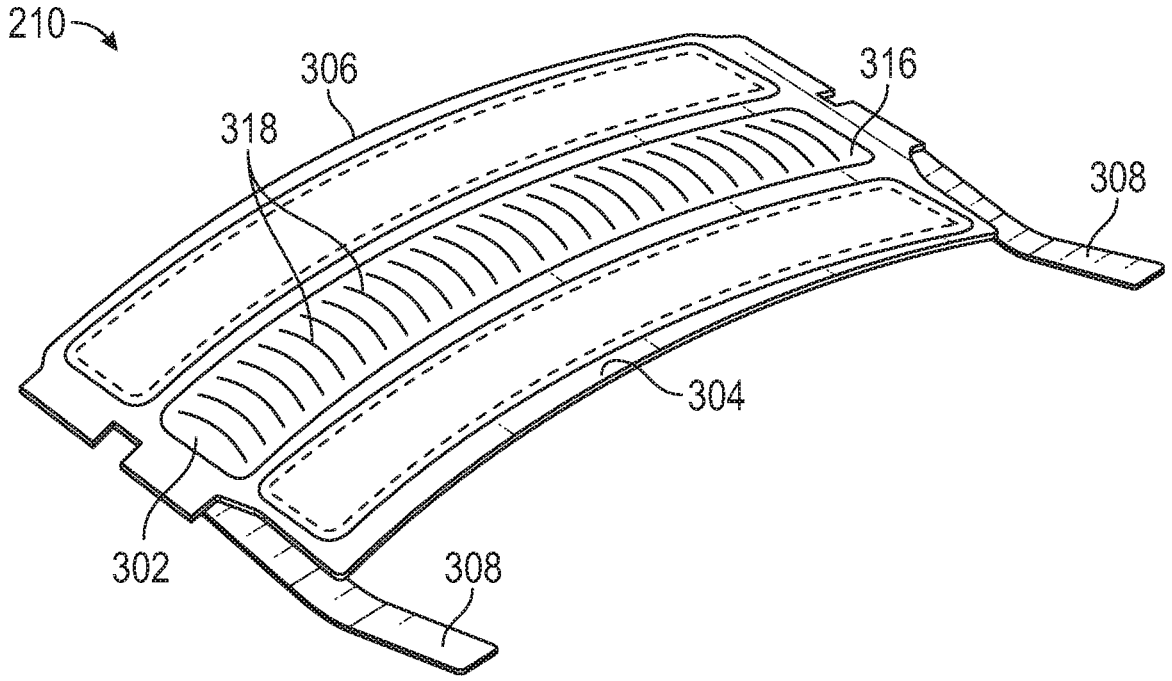

FIGS. 3A to 3E illustrate an example design of a headband cushion cover 210 in accordance with certain aspects of the present disclosure. FIG. 3A shows the headband cushion cover 210 as installed on the headband 206 of the headphone assembly. FIG. 3B shows the headband cushion cover 210 in a folded state. FIGS. 3C, 3D and 3E show the headband cushion cover 210 in an open state.

As shown in FIG. 3C, the headband cushion cover 210 includes an elongated foam member 302, an elongated rear flap 304 and an elongated front flap 306. As shown in FIGS. 3A, 3B, and 3C, the elongated foam member 302 is pre-formed into an arched shape that substantially matches the arched shape of the headband 206. In an aspect, the foam member 302 is made of a soft foam material covered with polyurethane leather at least on an outer surface of the foam member 302 that faces and contacts the user's head. The soft foam material of the foam member 302 allows for a comfortable wear on or around the user's head, or around the user's neck region when the headphone assembly is not in use.

As shown in FIG. 3C, the rear flap 304 and the front flap 306 are attached on either side of the foam member 302 along its long edges. An inner long edge of the rear flap 304 is foldably attached along a first long edge of the elongated foam member 302, and an inner long edge of the front flap 306 is foldably attached along a second long edge of the elongated foam member 302. In an aspect, each of the rear flap 304 and the front flap 306 is pre-formed into an arched shape that substantially matches the arched shape of the headband 206.

In certain aspects, each of the rear flap 304 and the front flap 306 snaps between two opposite arched positions when folded along the respective inner edges of the flaps adjoining the foam member 302. As shown in FIG. 3C, each of the rear flap 304 and the front flap 306 is in one of the two arched positions when the headband cushion cover 210 is in an open state. As shown in FIGS. 3A and 3B, each of the rear flap 304 and the front flap 306 is in a second opposite arched position when the headband cushion cover 210 is in a closed state. In an aspect, as shown in FIG. 3D, each of the rear flap 304 and the front flap 306 includes an elongated insert 312 disposed along an inner surface of the flap, wherein the insert is pre-formed into an arched shape that substantially matches the arched shape of the headband and/or the foam member 302. As shown in FIG. 3D, an insert 312 is disposed between an inner surface of each of the rear and front flaps and a flexible cover 314 covering the inner surface of the flap. Each insert 312 is made of an elastic material (e.g., thermoformed plastic) which allows the insert 312 to be deformed to a flat state or near flat state by applying pressure, but snaps to one of the two opposite arched positions when the pressure is released. Each insert 312 has a threshold position when being folded from one of the arched positions towards the other arched position and snaps to the opposite arched position when folded past the threshold position. In an aspect, the threshold position of the insert 312 is a flat state or a near flat state. This allows each of the rear flap 304 and the front flap 306 which are attached to a respective insert 312, to snap between the two opposite arched positions when folded on to the foam member 302 along the inner edge of the flap adjoining the foam member 302. This snap fold feature of the rear and front flaps allows for an acceptably tight fit with the headband without using other securing methods such as screws, rivets, magnets etc. Additionally, the snap fold flaps provide an aesthetically clean look after installation on the headband 206.

In an aspect, each of the rear flap 304 and the front flap 306 is made of a flexible material which allows the flap to adhere to the shape of the insert and fold over the foam member 302 in an arched shape. In an aspect, instead of using the insert to implement the snap fold feature, each of the rear flap 304 and the front flap 306 is made from the elastic material pre-formed into the arched shape, thus allowing the rear and front flaps to snap between the two arched positions without using the insert.

In certain aspects, a width of the rear flap 304 is less than a width of the front flap 306, such that when the rear flap 304 is folded on to the foam member 302 and the front flap 306 is folded onto the folded rear flap 304, an outer edge of the front flap 306 cleanly aligns with the inner edge of the rear flap 304. As shown in FIGS. 3A and 3B, the outer edge of the front flap 306 cleanly aligns at 310 with the inner edge of the rear flap 304. This provides a cosmetically clean look after the headband cushion cover 210 is installed on to the headband 206.

As shown in FIGS. 3A to 3D, the headband cushion cover is provided with a hook and loop fastener 308 at each end to secure the ends of the front and the rear flaps to the headband 206 after the headband cushion cover 210 is installed on the headband 206. As shown in FIG. 3A each hook and loop fastener 308 folds over the folded rear and front flaps to secure the ends of the flaps to the headband 206.

FIG. 3E illustrates an example design of the headband cushion cover 210 provided with an inner perforated cover. As shown in FIG. 3E, an inner surface of the elongated foam member 302 is covered with a flexible covering 316 such as a thin flexible plastic sheet provided with perforations 318. The perforations 318 provided on the covering 316 allow the foam member 302 to breathe so that air is not trapped between the foam member 302 and the plastic covering 316. An additional functionality of the perforations 318 is to avoid any rigidity in the foam member 302 due to the covering 316 allowing the foam member 302 to remain flexible for installation on the head band 206.

In certain aspects, the above described design of the headband cushion allows easy installation by following instructions, while at the same time providing for a clean aesthetically pleasing high quality headband assembly that is comfortable to wear for fairly long time periods.

Figure 4A:
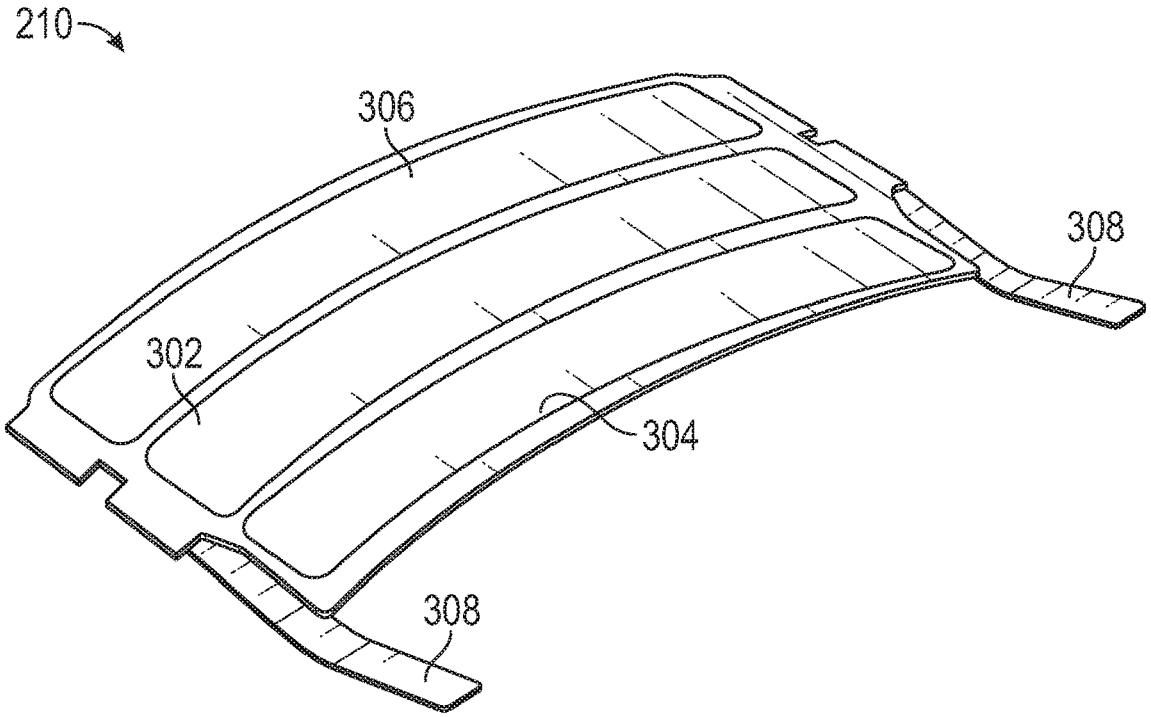
FIGS. 4A to 4H illustrate example installation of the headband cushion cover 210 on the headband 206, in accordance with certain aspects of the present disclosure.
Figure 4B:
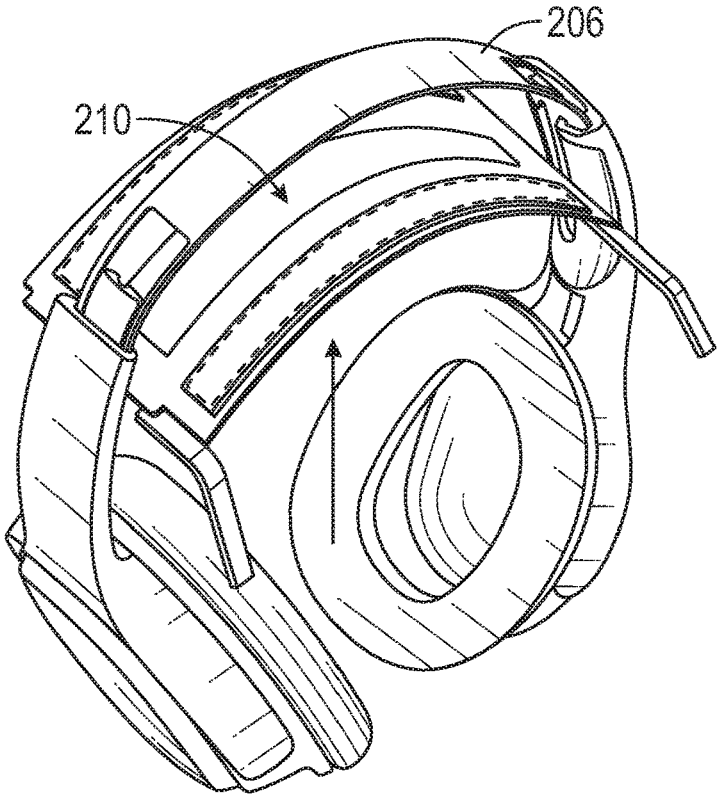
Figure 4C:
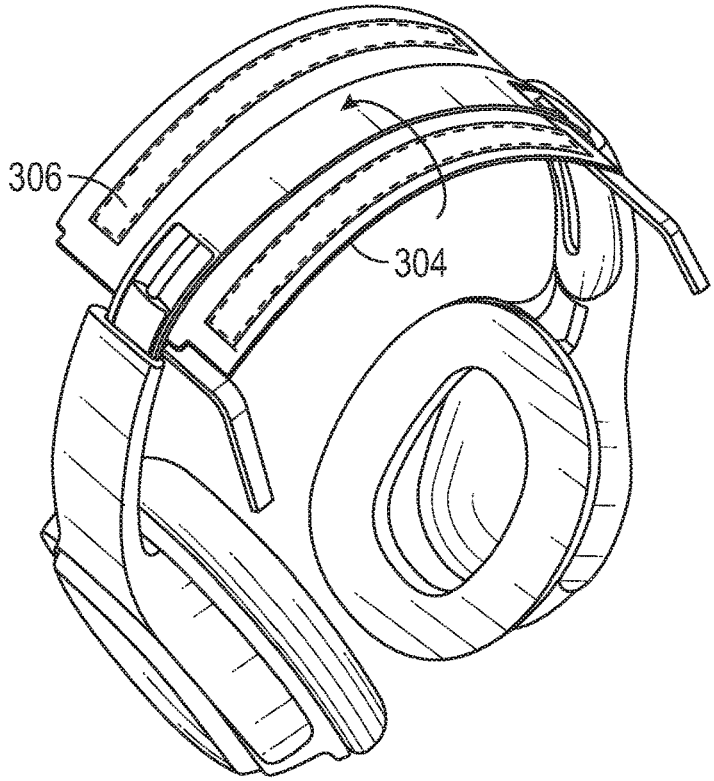
Figure 4D:
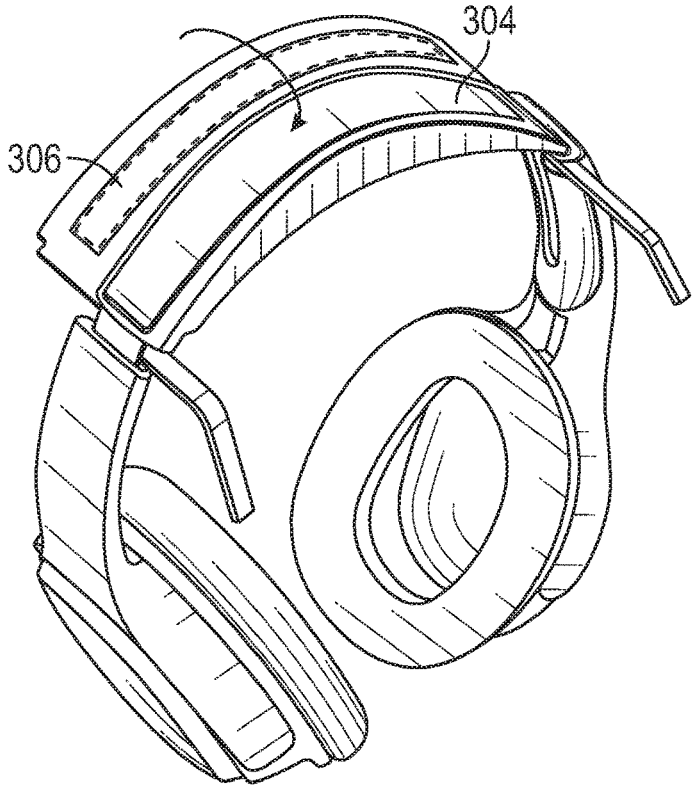
Figure 4E:
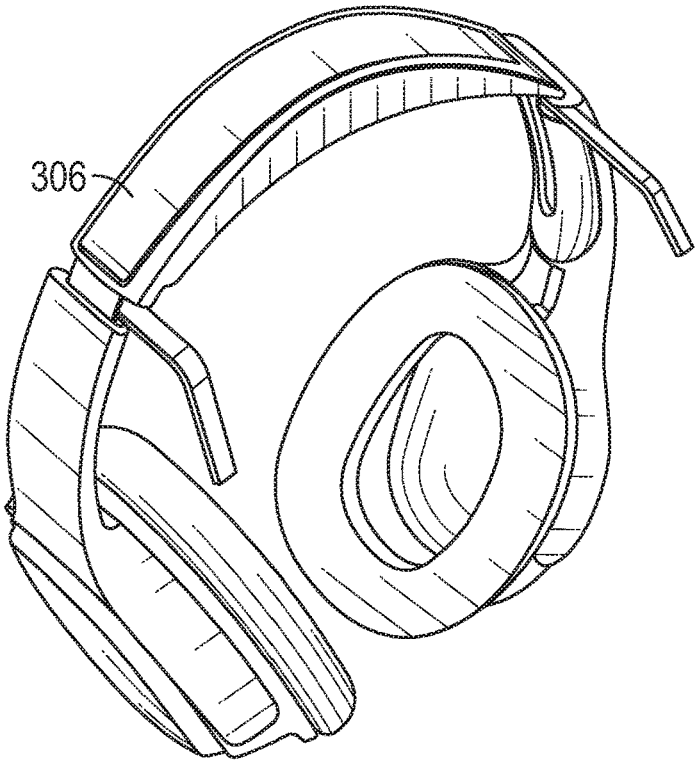
Figure 4F:
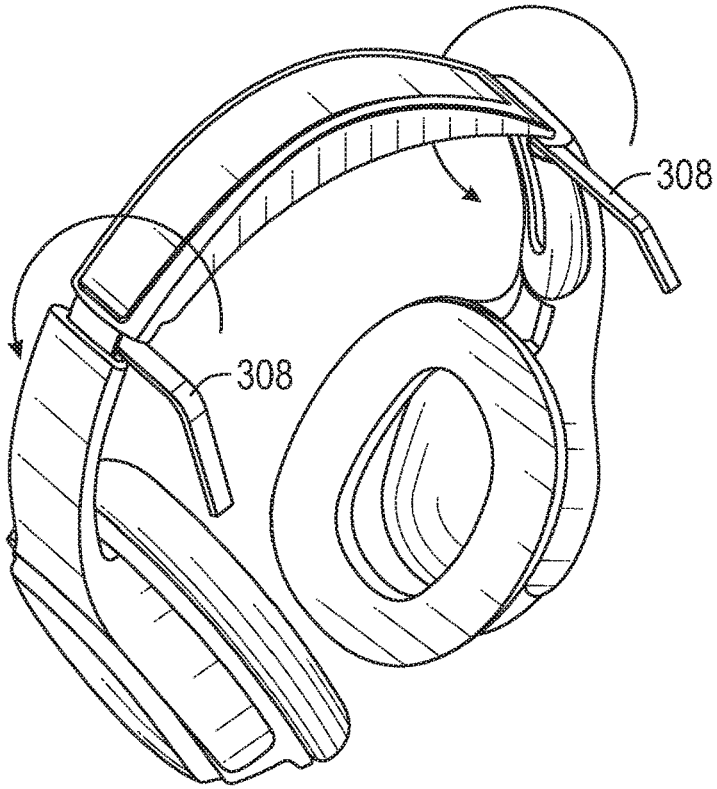
Figure 4G:
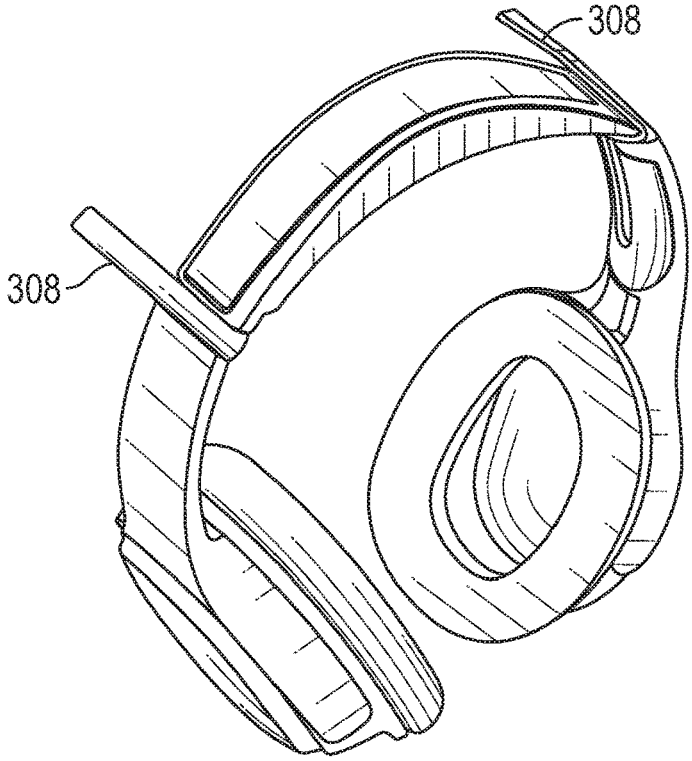
Figure 4H:
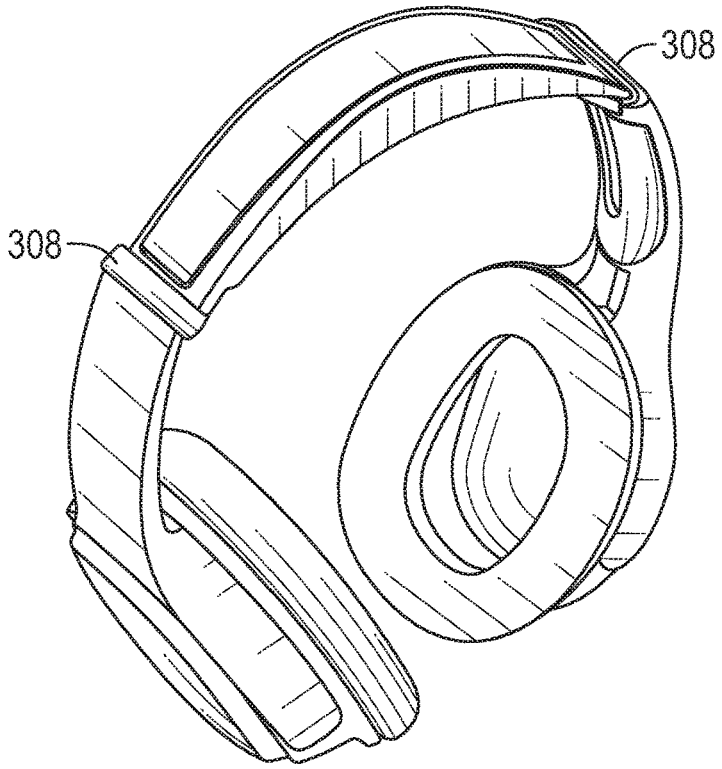

FIGS. 4A to 4H illustrate example stepwise installation of the headband cushion cover 210 on the headband 206, in accordance with certain aspects of the present disclosure. FIGS. 4A to 4H show a series of steps for installation of the headband cushion cover 210 on the headband 206. As shown in FIG. 4A, the installation starts with the headband cushion 210 in its fully open state with the rear flap 304 and front flap 306 in an open state. As shown in FIG. 4B, the headband cushion cover 210 is positioned and lined up below the headband 206 and lifted into place under the headband 206. As shown in FIG. 4C, the rear flap 304 is folded over the top of the headband 206. As shown in FIG. 4D, as the rear flap 304 is folded from its open arched position, it snaps into its closed arched position over the headband 206. As shown in FIG. 4D, the front flap 306 is folded over the folded rear flap 304. As shown in FIG. 4E, as the front flap 306 is folded from its open arched position, it snaps into its closed arched position over the headband 206. FIG. 4E shows a stage during the installation when both the rear and front flaps have been folded over the headband 206. In FIGS. 4F, 4G and 4H, the hook and loop fasteners 308 are folded as shown around the headband and on top of the folded rear and front flaps to secure the ends of the flaps to the headband 206.

Figure 5A:
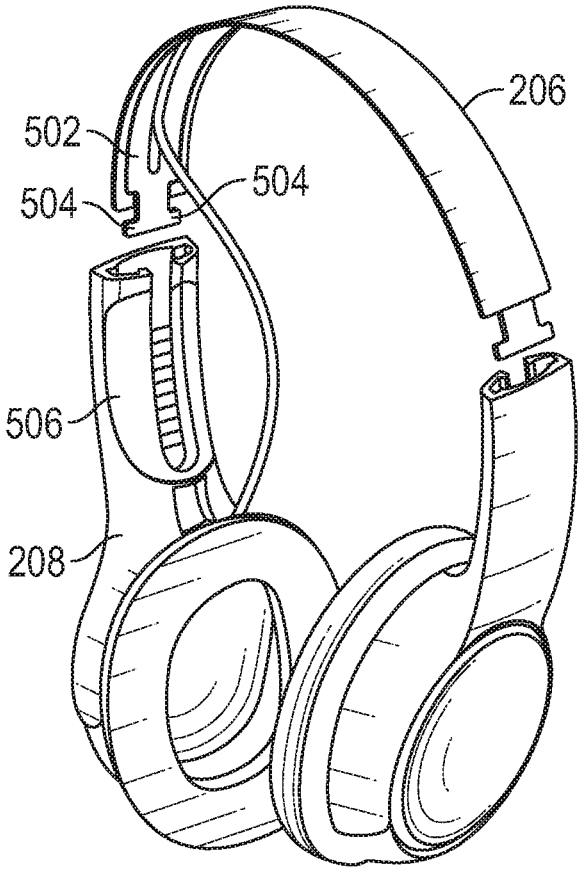
FIG. 5A illustrates an example design of the headband 206 and the yoke member 208, in accordance with certain aspects of the present disclosure.

FIG. 5A illustrates an example design of the headband 206 and the yoke member 208, in accordance with certain aspects of the present disclosure.

As discussed in the above paragraphs, each yoke member 208 is used to load one of the ear cups 202 on a different end of the headband 206. As shown in FIG. 5A, each yoke member 208 is provided with an elongated channel 506 at one end. The yoke member 208 is connected to an end of the headband 206 by inserting the end of the headband 206 into the channel 506 of the yoke member 208. Once inserted into the channel 506, the headband slides in and out within the channel 506. Further, as shown in FIG. 5A, the headband is provided with protrusions 504 which engage with tabs (not shown) provided within the channel 506 to provide a mechanical stop for the headband 206 when it is being slid up the channel 506, so that the headband 206 does not slide out of the yoke member 208. Additionally or alternatively, as shown in FIG. 5A, each end of the headband 206 comes pre-loaded with a wire guide 502 that holds the electrical wire connecting the ear cups 202 in a region where the wire has some slack to allow a length of the headband to be adjusted between the ear cups 202 to suit a user's listening position.

Figure 5B:
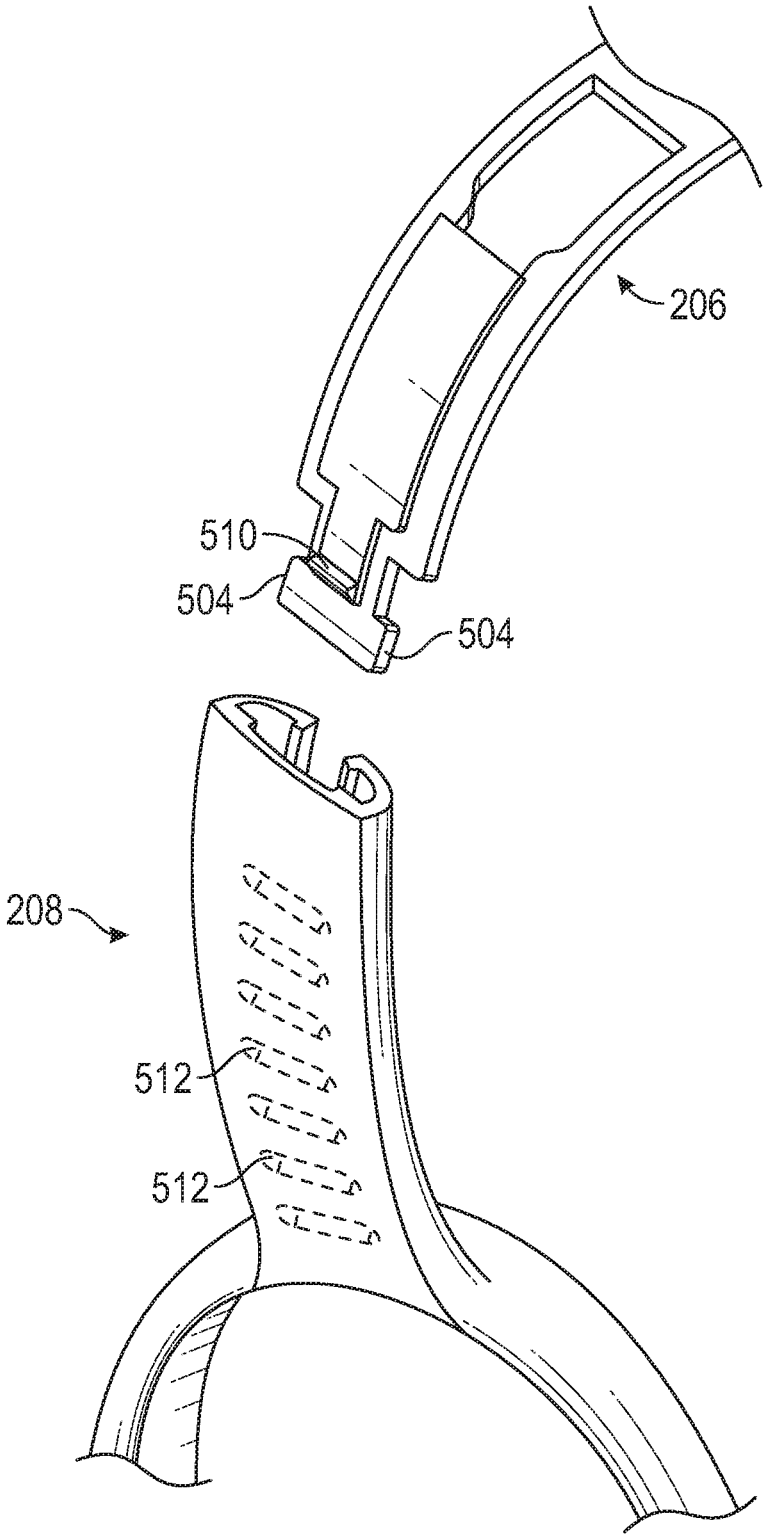
FIG. 5B illustrates an example design for engagement of the headband 206 with the yoke member 208, in accordance with certain aspects of the present disclosure.

FIG. 5B illustrates an example design for engagement of the headband 206 with the yoke member 208, in accordance with certain aspects of the present disclosure. As shown in FIG. 5B, the headband 206 is provided with a protruded tab 510 at each end which glides on detents 512 provided on an inner surface of the channel 506. Each detent 512 engages the headband 206 by providing an opposing force to the tab 510 of the headband 206 until a strong enough force is applied to move the tab 510 to the next detent 512. The tab and detent mechanism allows the headband 206 to be adjusted and held at different positions when sliding in and out of the yoke member 208 to allow a user to adjust a length of the headband 206 between the ear cups 202.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein, but is to be accorded the widest scope consistent with the principles and novel features disclosed herein.

The invention claimed is:

1. A headphone assembly capable of assembly by an end consumer, comprising:

a left ear cup and a right ear cup, the left and right ear cups pre-connected with an electrical wire;

an elongated headband pre-formed into an arched shape, each of the left and right ear cups loaded on to a different end of the headband using a yoke member, each yoke member connecting one of the ear cups to the headband; and a headband cushion cover that covers an arched portion of the headband, the headband cushion cover comprising:

an elongated foam member;

an elongated rear flap, an inner edge of the rear flap foldably attached along a first edge of the elongated foam member; and an elongated front flap, an inner edge of the front flap foldably attached along a second edge of the elongated foam member, wherein each of the front and rear flaps snaps between an open arched position and a closed arched position when folded along the respective inner edges of the flaps, wherein each of the front and rear flaps includes an insert disposed along an inner surface of the flap, the insert pre-formed into an arched shape that substantially matches the arched shape of the headband, such that the flap snaps between the open arched position and the closed arched position when folded along the inner edge of the flap, wherein the insert is made of an elastic material that allows the insert to be deformed to a flat state or near flat state and restore to one of the two arched positions, wherein the headband cushion cover is securely attached to the elongated headband when the elongated foam member is positioned under an arched portion of the elongated headband and when each of the front and rear flaps is folded on to the arched portion of the elongated headband from a respective open arched position to a closed arched position.

2. The headphone assembly of claim 1, wherein each of the front and rear flaps is pre-formed into an arched shape that substantially matches the arched shape of the headband.

3. The headphone assembly of claim 1, wherein each of the front and rear flaps along with the insert is made of a flexible material allowing the flap to fold over the elongated foam member.

4. The headphone assembly of claim 1, wherein the insert is made of thermoformed plastic.

5. The headphone assembly of claim 1, wherein the headband cushion cover further comprises a hook and loop fastener to secure the ends of the front and rear flaps to the headband after the headband cushion cover is installed on the headband.

6. The headphone assembly of claim 1, wherein an outer surface of the elongated foam member is covered with a soft material.

7. The headphone assembly of claim 1, wherein the headband cushion cover conceals the electrical wire connecting the left and right ear cups.

8. The headphone assembly of claim 1, wherein a width of the elongated rear flap is shorter than a width of the elongated front flap, such that when the rear flap is folded onto the elongated foam member and the front flap is folded onto the rear flap, an outer edge of the front flap aligns with the inner edge of the rear flap.

9. The method of claim 1, wherein the elongated foam member is pre-formed into an arched shape that substantially matches the arched shape of the headband.

10. A headband cushion cover for installation on a headband of a headphone assembly, comprising:

an elongated foam member;

an elongated rear flap, an inner edge of the rear flap foldably attached along a first edge of the elongated foam member; and an elongated front flap, an inner edge of the front flap foldably attached along a second edge of the elongated foam member, wherein each of the front and rear flaps snaps between an open arched position and a closed arched position when folded along the respective inner edges of the front and rear flaps, wherein each of the front and rear flaps includes an insert disposed along an inner surface of the flap, the insert pre-formed into an arched shape that substantially matches the arched shape of the headband, such that the flap snaps between the open arched position and the closed arched position when folded along the inner edge of the flap, wherein the insert is made of an elastic material that allows the insert to be deformed to a flat state or near flat state and restore to one of the two arched positions, wherein the headband cushion cover is securely attached to the headband when the elongated foam member is positioned under an arched portion of the headband and when each of the front and rear flaps is folded on to the arched portion of the headband from a respective open arched position to a closed arched position, wherein the headband cushion cover is designed to cover an arched portion of the headband.

11. The headband cushion cover of claim 10, wherein each of the front and rear flaps along with the insert is made of a flexible material allowing the flap to fold over the elongated foam member.

12. The headband cushion cover of claim 10, wherein the elongated insert is made of thermoformed plastic.

13. The headband cushion cover of claim 10, wherein the headband cushion cover further comprises a hook and loop fastener to secure the ends of the front and rear flaps to the headband after the headband cushion cover is installed on the headband.

14. The headband cushion cover of claim 10, wherein a width of the elongated rear flap is shorter than a width of the elongated front flap, such that when the rear flap is folded onto the elongated foam member and the front flap is folded onto the rear flap, an outer edge of the front flap aligns with the inner edge of the rear flap.

15. A headband cushion cover for installation on a headband of a headphone assembly, comprising:

an elongated foam member;

an elongated rear flap, an inner edge of the rear flap foldably attached along a first edge of the elongated foam member;

an elongated front flap, an inner edge of the front flap foldably attached along a second edge of the foam member, wherein each of the front and rear flaps snap between an open arched position and a closed arched position when folded along the respective inner edges of the front and rear flaps, wherein each of the front and rear flaps includes an insert disposed along an inner surface of the flap, the insert pre-formed into an arched shape that substantially matches the arched shape of the headband, such that the flap snaps between the open arched position and the closed arched position when folded along the inner edge of the flap, wherein the insert is made of an elastic material that allows the insert to be deformed to a flat state or near flat state and restore to one of the two arched positions, wherein the headband cushion cover is securely attached to the headband when the elongated foam member is positioned under an arched portion of the headband and when each of the front and rear flaps is folded on to the arched portion of the headband from a respective open arched position to a closed arched position; and a hook and loop fastener to further secure the ends of the headband cushion cover to the headband after the headband cushion cover is attached onto the headband, wherein the headband cushion cover covers an arched portion of the headband.

* * * * *